US006364711B1

(12) United States Patent
Berg et al.

(10) Patent No.: US 6,364,711 B1
(45) Date of Patent: Apr. 2, 2002

(54) FILTERED ELECTRICAL CONNECTOR

(75) Inventors: Paul Christopher Berg, Batavia; Duane M. Fencl, Countryside, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/693,729

(22) Filed: Oct. 20, 2000

(51) Int. Cl.[7] ..... H01R 12/66
(52) U.S. Cl. ..... 439/620
(58) Field of Search ..... 439/620; 333/181, 333/182, 183, 184, 185

(56) References Cited

U.S. PATENT DOCUMENTS 5,456,616 A * 10/1995 Fuerst et al. ..... 439/620
5,551,893 A * 9/1996 Johnson ..... 439/620
6,174,203 B1 * 1/2001 Asao ..... 439/620

* cited by examiner

*Primary Examiner*—Tho D. Ta
(74) *Attorney, Agent, or Firm*—Stacey E. Caldwell; A. A. Tirva

(57) ABSTRACT

A filtered electrical connector includes a dielectric housing having an array of terminal-receiving passages and at least one mounting post projecting from the housing outside the array of passages. A plurality of terminals are received in the passages and include a plurality of pin portions projecting from the housing in the same direction as the mounting post. A filter block is fit over the pin portions of the terminals. The filter block includes a plurality of pin-receiving holes through which the pin portions of the terminals extend. A mounting hole in the filter block is closely fit about the mounting post projecting from the housing.

16 Claims, 2 Drawing Sheets

FILTERED ELECTRICAL CONNECTOR

FIELD OF THE INVENTION

This invention generally relates to the art of electrical connectors and, particularly, to a filtered electrical connector.

BACKGROUND OF THE INVENTION

Generally, an electrical connector includes some form of dielectric housing which mounts a plurality of conductive terminals for making electrical connection with the terminals of a complementary mating connector or other connecting device or to the circuit traces on a printed circuit board, flat flexible cable or the like. Many connectors are shielded or filtered to protect against interference with the electrical signals carried by the terminals.

For instance, a shielded connector may have external shields to protect against ingress or egress of electromagnetic interference (EMI) or radio frequency interference (RFI) at the connector interface. A filtered connector may have some form of internal filtering element or elements to prevent internal interference or "cross talk" between the terminals of the connector.

One form of filtered connector includes a plurality of terminal pins which extend through holes in a filtering block, such as a block fabricated of ferrite material. The ferrite block typically is held onto the terminal pins by a thin plastic sheet, such as polyester film. The plastic sheet has holes press-fit over the terminal pins, whereby the plastic sheet performs a dual function of holding the ferrite block on the terminal pins as well as providing a spacing aligner for the pins.

One of the problems in using ferrite filtering blocks of the character described above is that the blocks tend to push the plastic aligner sheet off of the terminal pins. In addition, the pin holes in the ferrite block are larger than the pins, themselves, because it is difficult to maintain sufficiently precise tolerances in ferrite or similar materials. Consequently, the ferrite block tends to impact against the pins as well as rub against the pins, resulting in abrasion of the highly conductive plating on the pins. Furthermore, the ferrite block can force the plastic sheet away from the pins. Nor will a press-fit polyester film sufficiently hold the ferrite block on the filtered connector without some additional encapsulation. The present invention is directed to solving these various problems by a unique mounting of filtering blocks, such as of ferrite material, onto connectors about portions of terminals such as terminal pins.

SUMMARY OF THE INVENTION

An object, therefore, of the invention is to provide a new and improved filtered electrical connector of the character described.

In the exemplary embodiment of the invention, the connector includes a dielectric housing having an array of terminal-receiving passages and at least one mounting post projecting from the housing outside the array of passages. A plurality of terminals are received in the passages and include a plurality of pin portions projecting from the housing in the same direction as the mounting post. A filter block is fitted over the pin portions of the terminals. The filter block includes a plurality of pin-receiving holes through which the pin portions of the terminals extend and a mounting hole closely fit about the mounting post projecting from the housing. In the preferred embodiment, the filter block comprises a ferrite block.

According to one aspect of the invention, a distal end of the mounting post is expanded over the filter block to hold the block on the mounting post. The mounting post also includes an abutment portion projecting from at least one side thereof and against which the filter block abuts when positioned over the mounting post. In the preferred embodiment, a plurality of the mounting posts project from the housing and into a corresponding plurality of mounting holes in the filter block. The terminal-receiving passages and respective pin portions are arranged in a generally linear array, with one of the mounting posts located at each opposite end of the linear array.

According to another aspect of the invention, an alignment sheet is press-fit onto the mounting post over the filter block and includes a plurality of pin-receiving holes closely fit about the pin portions of the terminals. A distal end of each mounting post is expanded over the alignment sheet to hold the sheet and the filter block on the mounting posts.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
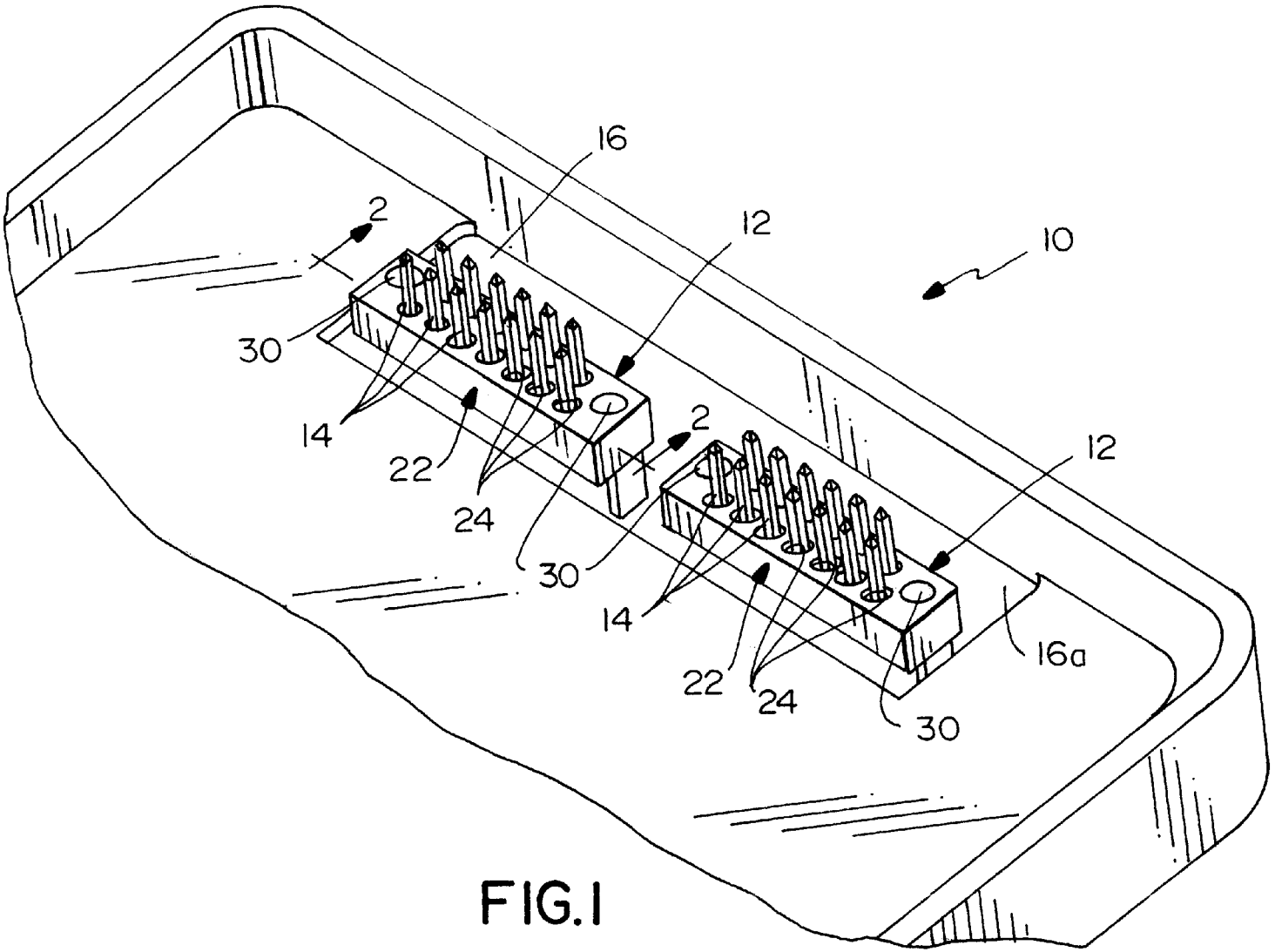
FIG. 1 is a fragmented perspective view of an electrical connector embodying the concepts of the invention.
Figure 2:
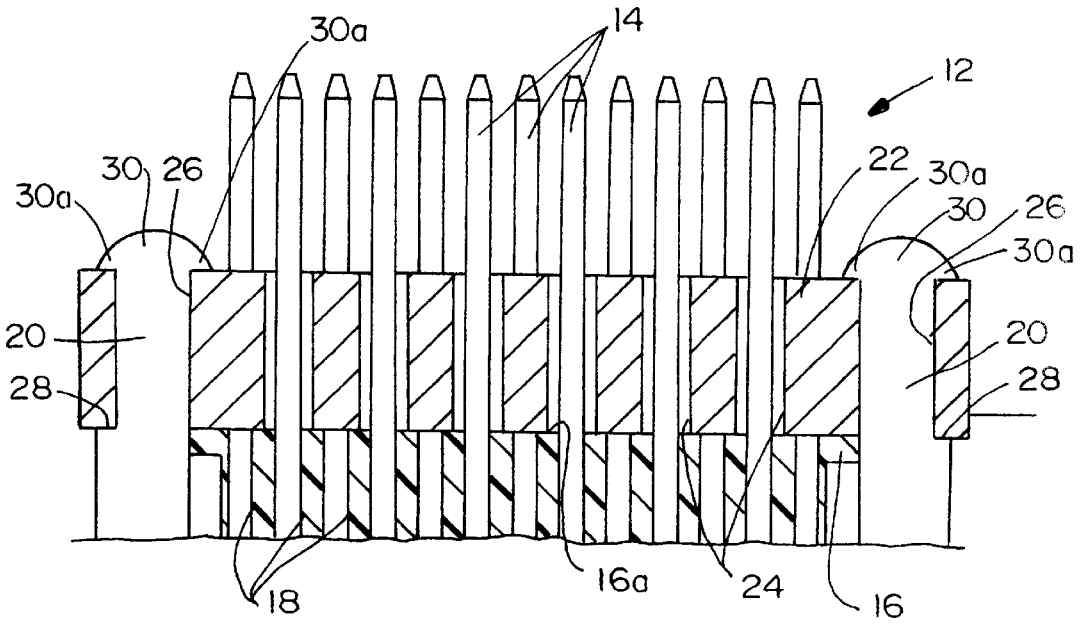
FIG. 2 is a fragmented section taken generally along line 2—2 of FIG. 1.

Referring to the drawings in greater detail, and first to FIG. 1, the invention is embodied in a header connector assembly, generally designated 10, which, itself, includes a pair of filtered electrical connectors, generally designated 12. Header connector assembly 10 is shown fragmented, and all of the components of connectors 12 are not shown, because the invention can be embodied in a wide variety of electrical connector configurations. Suffice it to say, each filtered connector 12 includes a plurality of terminals which have pin portions 14 projecting from a housing 16 of the connector assembly. As seen in FIG. 1, pin portions 14 of each filtered connector 12 are in a generally linear array formed by two generally parallel rows of the pin portions. FIG. 2 shows that the pin portions are received in a plurality of terminal-receiving passages 18 in housing 16 and project away from a rear face 16*a* of the housing. The housing also has a mounting post 20 (FIG. 2) projecting therefrom outside each end of the array of terminal-receiving passages and in the same direction as pin portions 14.

Referring to both FIGS. 1 and 2, the invention contemplates a filter block 22 provided for each filtered connector 12 and fitted over pin portions 14 of the connector terminals. The block is fabricated of electromagnetic filtering material such as ferrite. The ferrite block includes a plurality of pin-receiving holes 24 through which pin portions 14 of the terminals project. As best seen in FIG. 2, pin-receiving holes

24 are larger than pin portions 14 so that ferrite block 22 does not impact or otherwise abrade the pin portions. The ferrite block also includes a mounting hole 26 (FIG. 2) closely fit about each mounting post 20. Each mounting post includes an abutment shoulder 28 on the outside thereof and against which ferrite block 22 abuts when positioned over the mounting posts.

Housing 16 and particularly mounting posts 20 preferably are fabricated of plastic material or the like which is deformable such as by cold staking, ultrasonic welding or other method. Therefore, the invention contemplates that the distal ends 30 of the mounting posts be staked or expanded over the top of the ferrite block, as at 30*a*, to hold the ferrite block down onto abutment shoulders 28 of the mounting posts.

Therefore, by sandwiching ferrite block 22 between abutment shoulders 28 of mounting posts 20 and expanded portions 30*a* of the distal ends of the posts, the ferrite block is secured against movement relative to the terminal pin portions 14 in a direction generally parallel to the pin portions. In addition, with the ferrite block being closely fit about mounting posts 20, the block is prevented from moving transversely of the pin portions, with the pin portions spaced from the insides of enlarged holes 24 in the ferrite block.

Figure 3:
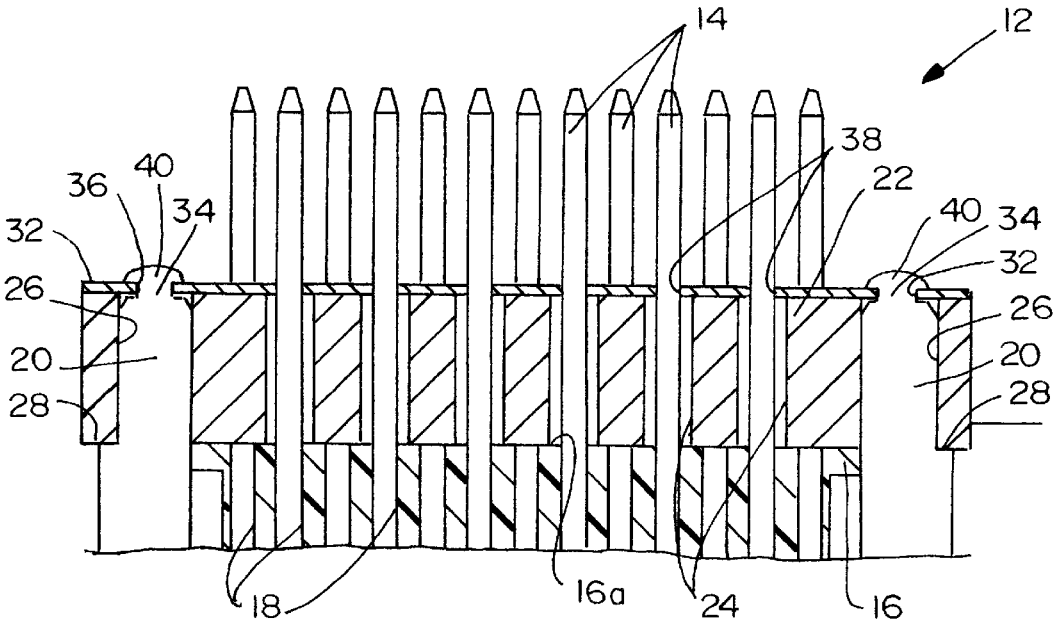
FIG. 3 is a view similar to that of FIG. 2, but of an alternative embodiment of the invention.

FIG. 3 shows an alternative embodiment of the invention, wherein an alignment sheet 32 is positioned over a reduced-diameter portion 34 of each mounting post 20, so that the reduced diameter portion of the post is closely fit within a respective hole 36 in the alignment sheet. A plurality of holes 38 are formed in the alignment sheet for closely fitting about terminal pin portions 14. Therefore, the alignment sheet can properly space and align the terminal pin portions by using the more robust mounting posts 20. The alignment sheet may be fabricated of plastic material such as polyester film or the like. The mounting posts are staked over the alignment sheet to prevent the alignment sheet from moving away from the mounting posts. Consequently, mounting posts 20 are staked to the alignment sheet to secure both ferrite block 22 and alignment sheet 32 and prevent both the block and the sheet from moving transversely of terminal pin portions 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A filtered electrical connector, comprising:

a dielectric housing having an array of terminal-receiving passages and at least one mounting post projecting from the housing outside said array of passages;

a plurality of terminals received in said passages and including a plurality of pin portions projecting from the housing in the same direction as the mounting post;

a single ferrite filter block fitted over the pin portions of a plurality of the terminals, the filter block including a plurality of pin-receiving holes through which the pin portions of the terminals extend and a mounting hole closely fit about the mounting post projecting from the housing; and an alignment sheet press fit onto the mounting post over the filter block and including a plurality of pin-receiving holes closely fit about the pin portions of the terminals.

2. The filtered electrical connector of claim 1 wherein said filter block comprises a ferrite block.

3. The filtered electrical connector of claim 1 wherein said mounting post includes an abutment portion projecting from at least one side thereof and against which the filter block abuts when positioned over the mounting post.

4. The filtered electrical connector of claim 1 wherein a distal end of the mounting post is expanded over the alignment sheet to hold the sheet and the filter block on the mounting post.

5. The filtered electrical connector of claim 1 wherein a distal end of the mounting post is expanded over the filter block to hold the block on the mounting post.

6. The filtered electrical connector of claim 1, including a plurality of said mounting posts projecting from the housing and into a corresponding plurality of mounting holes in the filter block.

7. The filtered electrical connector of claim 6 wherein said terminal-receiving passages and respective pin portions are arranged in a generally linear array, with one of said mounting posts located at each opposite end of the linear array.

8. A filtered electrical connector, comprising:

an elongated dielectric housing having a generally linear array of terminal-receiving passages and a mounting post projecting from the housing at each opposite end of the linear array;

a plurality of terminals received in said passages and including a plurality of pin portions projecting from the housing in the same direction as the mounting post;

a single ferrite filter block fitted over the pin portions of a plurality of the terminals, the filter block including a plurality of pin-receiving holes through which the pin portions of the terminals extend and a pair of mounting holes closely fit about the mounting posts projecting from the housing;

a distal end of each mounting post being expanded over the filter block to hold the block on the mounting posts; and an alignment sheet press fit onto the mounting posts over the filter block and including a plurality of pin-receiving holes closely fit about the pin portions of the terminals.

9. The filtered electrical connector of claim 8 wherein each of said mounting posts includes an abutment portion projecting from at least one side thereof and against which the filter block abuts when positioned over the mounting posts.

10. The filtered electrical connector of claim 8 wherein a distal end of each mounting post is expanded over the alignment sheet to hold the sheet and the filter block on the mounting posts.

11. A filtered electrical connector, comprising:

a dielectric housing having a plurality of terminal-receiving passages and at least one mounting post projecting from the housing;

a plurality of terminals received in said passages and including a plurality of pin portions projecting from the housing in the same direction as the mounting post;

a single ferrite filter block fitted over the pin portions of a plurality of the terminals and including a mounting hole closely fit about said mounting post; and an alignment sheet press fit onto the mounting post over the filter block and including a plurality of pin-receiving holes closely fit about the pin portions of the terminals.

12. The filtered electrical connector of claim 11 wherein said mounting post includes an abutment portion projecting from at least one side thereof and against which the filter member abuts when positioned over the mounting post.

13. The filtered electrical connector of claim 11 wherein a distal end of the mounting post is expanded over the alignment sheet to hold the sheet and the filter member on the mounting post.

14. The filtered electrical connector of claim 11 wherein a distal end of the mounting post is expanded over the filter member to hold the block on the mounting post.

15. The filtered electrical connector of claim 11, including a plurality of said mounting posts projecting from the housing and into a corresponding plurality of mounting holes in the filter member.

16. The filtered electrical connector of claim 11 wherein said terminal-receiving passages and respective pin portions are arranged in a generally linear array, with one of said mounting posts located at each opposite end of the linear array.

* * * * *